United States Patent [19]

Akerlund et al.

[11] 4,311,553

[45] Jan. 19, 1982

[54] METHOD FOR USE IN THE DEFIBRATION OR REFINING OF LIGNOCELLULOSE-CONTAINING FIBROUS MATERIALS

[75] Inventors: Sven G. Akerlund, Sollentuna; Jan-Erik Höök, Lilla Edet, both of Sweden

[73] Assignees: Sunds Defibrator AB; Eka AB, both of Stockholm, Sweden

[21] Appl. No.: 111,624

[22] Filed: Jan. 14, 1980

[30] Foreign Application Priority Data

Jan. 12, 1979 [SE] Sweden ..... 7900302

[51] Int. Cl.[3] ..... D21B 1/12

[52] U.S. Cl. ..... 162/23; 162/26; 162/78; 162/80; 162/90

[58] Field of Search ..... 162/23, 25, 26, 17, 162/78, 80, 28, 90

[56] References Cited

FOREIGN PATENT DOCUMENTS 2818320 11/1978 Fed. Rep. of Germany ..... 162/25

*Primary Examiner*—Peter Chin

*Attorney, Agent, or Firm*—Eric Y. Munson

[57] ABSTRACT

A method of producing peroxide bleached pulp. Lignocellulose fiber material is impregnated with an aqueous silicate solution containing a sequestering agent. The impregnated lignocellulose is preheated with saturated steam at a temperature corresponding to the defibrating temperature to precipitate silic acid on and in the fibers. The preheated fiber mass is defibrated between two grinding disc in an atmosphere of saturated steam at a temperature of 100°-170° C. Alkaline peroxide solution free of silicate is introduced into the grinding space.

6 Claims, No Drawings

METHOD FOR USE IN THE DEFIBRATION OR REFINING OF LIGNOCELLULOSE-CONTAINING FIBROUS MATERIALS

The present invention can be used in the preparation of mechanical, chemi-mechanical and semi-chemical fibrous pulps of lignocellulose-containing materials such as softwood, hardwood, bagasse, straw and similar fibrous materials, which have been comminuted in an appropriate manner to chips, chaff or coarse fibrous pulp and which will hereinafter be referred to as "chips" or "coarse pulp" respectively. The invention finds particular application in the preparation of mechanical pulps by the treatment of chips or coarse pulp in disc refiners to yield either so-called refiner mechanical pulps or thermo-mechanical pulps (so-called TMP). The former types are prepared by grinding chips at atmospheric pressure, the latter by grinding at a positive pressure and elevated temperature (100°–170° C.).

It is known through our Swedish Patent Application No. 7703137-5 that benefits can be secured by bleaching mechanical pulps at temperatures appreciably above 100° C. with alkaline, peroxide-containing bleaching liquors, if the bleaching is carried out in a disc refiner and the bleaching liquor is fed directly into the grinding zone between the mutually rotatable grinding discs, one of which may be stationary and is then termed the stator disc. In the latter case it is simplest to introduce the bleaching liquor through holes or ducts in the stator disc, which holes or ducts open directly into the grinding zone. The bleaching liquor may consist of a peroxide solution prepared in a known manner and containing, in addition to hydrogen peroxide, also alkali and a protective colloid, usually sodium silicate, plus often a sequestering agent of the DTPA type.

After a lengthy period of operation, however, it has been found that problems can be caused by the precipitation of insoluble deposits, consisting primarily of silicic acids and to some extent of insoluble silicates.

The insoluble deposits tend to form in the pattern of the grinding discs, resulting in a deterioration in the efficiency of grinding.

Therefore, according to the invention, the chips or the coarse pulp is impregnated, before refiner treatment, with an aqueous solution of a soluble silicate, such as sodium silicate, whereafter peroxide bleaching can be carried out with fully satisfactory results using a silicate-free alkaline peroxide solution. At the same time the above-mentioned deposits on the grinding discs are eliminated. Impregnation can be effected by any known method that is applicable to the starting material. Chips are best impregnated by being first steamed and then compressed, whereafter they are introduced in the compressed state into a silicate solution in which they are permitted to expand and absorb the said solution. Excess, unabsorbed silicate solution can thereafter be removed, completely or partially, before the chips are fed into the refiner. Hardwood chips can also be impregnated with advantage by immersion in silicate solution, which is readily absorbed thanks to the large lumen ducts in hardwood. Coarse pulp is most readily impregnated by infusion with silicate solution, which is absorbed by the pulp through diffusion for a suitable period. Excess, unabsorbed silicate solution can be removed in a known manner, as by vacuum filtration or by squeezing.

If, in accordance with a further characteristic of the invention, the chips are impregnated with a solution of sodium silicate at a pH in the range 6–10 and at a defibrating temperature of 100° C. or higher, in the range 100°–170° C., the efficiency of the refiner is enhanced. This results in a more rapid grinding process and the strength characteristics of the resulting pulp are considerably better than when defibration is carried out without prior impregnation with silicate. A higher degree of beating (lower freeness) is achieved with the silicate-impregnated chips than with non-impregnated chips at the same production.

It is probable that the improved efficiency of defibration is related to the precipitation of silicic acids in and on the fibres, forming a silicic acid structure which makes the fibres more rigid and the fibre surfaces harder, whereby grinding and fibrillation take place more rapidly even at a comparatively high temperature. Normally, at 100° C. and above, fibrous pulps with a high content of lignin and hemicelluloses exist in a plastic state which has been described further in, for example, our Swedish Pat. No. 308983. Under these conditions it is very difficult to induce the fibre to "respond" to grinding. The degree of beating increases slowly and the resulting pulp has poor strength characteristics, with the exception of tearing resistance, indicating that grinding at high temperatures, in the range from 100° C. to 200° C., has the effect of "kneading" the pulp without appreciably shortening the fibres.

The precipitation of silicic acids on the fibres has been brought about concurrently with the feeding of the impregnated chips into the defibrator preheater, wherein the retention time may range from 1 to 10 minutes and the temperature is usually the same as in the defibrator, 100°–170° C., but may be lower if the feed between the preheater and the defibrator is arranged so as to be steam-tight. The acidic hydrolysis which commences in the lignocellulose-containing material as the latter is being heated up in the preheater causes the formation of organic acids which lower the pH value of the aqueous solution, whereupon silicic acids are precipitated.

Precipitation of silicic acids may also be brought about entirely or partially prior to feeding in to the preheater by neutralizing or acidifying the impregnating solution to a suitable pH value with organic or inorganic acids. The impregnating solution may then display an acidic, a neutral or a weakly alkaline reaction. The precipitation of silic acid in the manner described may also take place after the extraction of all or part of the excess, unabsorbed impregnating solution.

The effect on the grinding process obtained in the defibration and/or refining of fibrous pulp in which silicic acid has been precipitated resembles the effect observed in the refining of pulps rich in lignin or in hemicelluloses at a low temperature, around 60° C., when the whole of the intercellular substance exists in the solid phase. This increases, relatively, the rigidity and the hardness of the fibres, whereby the resistance to grinding and hence the efficiency of the grinding process are enhanced.

A similar effect has been observed in the case of the precipitation of sparingly soluble salts, such as silicates and carbonates of calcium and magnesium, in and on the fibrous material. Such precipitation can be brought about by first impregnating the lignocellulose-containing material with soluble alkaline salts, e.g. of silicic acid and carbonic acid, which are then displaced with soluble salts of calcium and magnesium. The impregnation and displacement of the salts can also be carried out in the reverse order.

In the bleaching of chips or coarse pulp with peroxide-containing solutions the entire quantity of silicate necessary for the bleaching process can be supplied at the impregnation stage without risk of poorer bleaching effect, and the result hereof is a pulp with considerably superior strength characteristics, as set forth in the following table:

Peroxide-bleached pulp prepared in conjunction with the TMP defibration of chips.

| | Amount in kg per tonne bone-dry pulp added in | | PROPERTIES OF PULP | | |
|---|---|---|---|---|---|
| Chemical | impregnation | defibration | Freeness CSF ml | Breaking length m | ISO-brightness % |
| TMP | None | None | 110 | 3 860 | 54.5 |
| $Na_2SiO_3$ | 20 | 0 | 180 | 4 455 | 55 |
| DTPA | 3.3 | 0 | 80 | 5 695 | 55 |
| pH[a] | 7.65 | 5.5 | | | |
| $H_2O_2$ | 0 | 21 | | | |
| NaOH | 0 | 9.8 | | | |
| $Na_2SiO_3$ | 20 | 0 | 160 | 4 655 | 66 |
| DTPA | 3.3 | 0 | | | |
| pH[a] | 7.65 | 8.35 | | | |

[a]pH after impregnation and defibrating, respectively.

We claim:

1. In the method of producing peroxide-bleached pulp from silicate impregnated lignocellulosic fiber material which is defibrated in an atmosphere of saturated steam at a temperature ranging between 100° C. and 170° C. within a grinding space defined between a pair of grinding discs which rotate relative to one another in a defibrating apparatus, the improvement preventing precipitation of silicic acid and insoluble silicates on the grinding discs and minimizing loss of peroxide, comprising the steps of (a) preheating a mass of lignocellulosic fiber material impregnated with an aqueous silicate solution containing a sequestering agent with saturated steam at a temperature corresponding substantially to the defibrating temperature to thereby precipitate silicic acid in and on the fiber, (b) passing said preheated impregnated fiber mass into said grinding space, and (c) reacting said preheated fiber mass with an alkaline peroxide solution free of silicate in said grinding space 2. The method according to claim 1, in which the mass of lignocellulosic fiber material is impregnated with a solution of silicate and a sequestering agent having a pH range between 6 and 10.

3. The method according to claim 2, in which the silicic acid components are precipitated by acidification with organic acids formed by the action of acidic hydrolysis during the preheating step.

4. The method according to claim 1, in which the lignocellulosic fiber mass is preheated for a period of time ranging from 1 minute to 10 minutes and at a steam temperature ranging between 100° C. and 170° C.

5. The method according to claim 1, in which the silicic acids are precipitated by the reaction with soluble salts of magnesium and calcium during the preheating step.

6. The method according to claim 1, in which the peroxide solution is supplied to the grinding space through ducts in the grinding discs.

* * * * *